US005592796A

United States Patent [19]

Landers

[11] Patent Number: 5,592,796

[45] Date of Patent: Jan. 14, 1997

[54] THERMALLY-IMPROVED METALLIC FRAMING ASSEMBLY

[76] Inventor: LeRoy A. Landers, 2322 Spruce St. Apt. 2F, Philadelphia, Pa. 19103

[21] Appl. No.: 353,090

[22] Filed: Dec. 9, 1994

[51] Int. Cl.[6] ..... E04B 2/60; E04C 3/32

[52] U.S. Cl. ..... 52/241; 52/483.1; 52/481.1

[58] Field of Search ..... 428/603, 604, 428/595, 598; 52/729, 738, 481.1, 731.5, 731.8, 731.9, 241, 479, 483.1, 781, 761, 267, 268, 269, 481.2

[56] References Cited

U.S. PATENT DOCUMENTS

| | | | |
|---|---|---|---|
| 772,662 | 10/1904 | Mallory | 52/364 |
| 939,749 | 11/1909 | Sagendorph | 52/481.1 |
| 1,643,577 | 9/1927 | Dornier | 52/731.2 |
| 1,803,589 | 5/1931 | Bohnsack | 52/241 |
| 2,268,517 | 12/1941 | Small | 52/481.1 |
| 2,410,922 | 11/1946 | Balduf | 52/481.1 |
| 2,633,945 | 4/1953 | Millier | 189/34 |
| 2,664,179 | 12/1953 | Gwynne | 189/34 |
| 2,931,470 | 4/1960 | Brown | 189/34 |
| 2,950,789 | 8/1960 | Davis et al. | 189/34 |
| 3,083,794 | 4/1963 | Stovall | 189/34 |
| 3,129,792 | 4/1964 | Gwynne | 189/34 |
| 3,243,930 | 4/1966 | Slowinski | 52/364 |
| 3,753,324 | 8/1973 | Puccio | 52/377 |
| 3,956,998 | 5/1976 | Bavetz | 110/1 A |
| 4,016,700 | 4/1977 | Blomstedt | 52/735 |
| 4,235,057 | 11/1980 | Teeters | 52/404 |
| 4,455,806 | 6/1984 | Rice | 52/732 |
| 4,619,098 | 10/1986 | Taylor | 52/738 |
| 4,713,921 | 12/1987 | Minialoff et al. | 52/579 |
| 4,793,113 | 12/1988 | Bodnar | 52/481.1 |
| 5,095,678 | 3/1992 | Murphy | 52/731.9 |
| 5,157,883 | 10/1992 | Meyer | 52/731.9 |
| 5,203,132 | 4/1993 | Smolik | 52/241 |
| 5,222,335 | 6/1993 | Petrecca | 52/731.5 |
| 5,285,615 | 2/1994 | Gilmour | 52/729 |

FOREIGN PATENT DOCUMENTS

| | | | |
|---|---|---|---|
| 3619398C1 | 7/1987 | Germany | 52/731.9 |
| 5-125768 | 5/1995 | Japan | 52/481.1 |
| 580 | of 1894 | United Kingdom | 52/729 |

OTHER PUBLICATIONS

"Hot Box Testing of Steel Studs" 1992 Sep. 18 Report by Portland State University(Frey, Lil)Enwall, Welch).

R. A. Nielson; "Ghost Mark" Prevention on Steel–Framed Walls; *Energy Design Update* vol. 15, No. 4; Apr. 1995 pp. 5–6.

Edward Barbour et al; Thermal Performance of Steel–Framed Walls; *Report Project No. 1006(2178)* The American Iron and Steel Institute, Nov. 1994 12 pages.

N. Malin; Steel or Wood Framing; *Environmental Building News* vol. 3 No. 4, Jul./Aug. 1994 pp. 1, 10–18.

A. Anderson; Studs of Steel; *Home Energy* vol. 11 No. 4; Jul./Aug. 1994 pp. 9–10.

R. Hawes; Steel–Framing Correction Table Proposed; *Energy Design Update* vol. 14 No. 5; May 1994 pp. 3–4.

K. Villar; Research Center Seeking Ways to Fix Theraml Problems; *Energy Design Update* vol. 14 No. 3; Mar. 1994 pp. 3–4.

W. Seaton; ASHRAE to Study Steel Framing and Foam Sheathing Performance; *Energy Design Update* vol. 13 No. 7; Jul. 1993 p. 3.

*Primary Examiner*—John Zimmerman

*Attorney, Agent, or Firm*—Woodcock Washburn Kurtz Mackiewicz & Norris

[57] ABSTRACT

A thermally-improved metallic channel [50] having a web [60] with one or more flanges [62] extending at generally perpendicular angles therefrom. At least one of said flanges [62] incorporates an inwardly-bent depression [64]. This depression [64] forms contact ridges [66] that are used as bearing surfaces against which adjacent materials [56,58] may be affixed. These contact ridges [66] along with an air space [70] resulting from said inwardly-bent depression [64] serve to decrease the rate of heat loss or heat gain due to conductivity between said thermally-improved metallic channel [50] and adjacent materials [56,58].

9 Claims, 6 Drawing Sheets

THERMALLY-IMPROVED METALLIC FRAMING ASSEMBLY

BACKGROUND

1. Field of the Invention

This invention relates to metallic channels used in various types of construction and, more particularly, to an improved configuration which reduces the thermal conductivity between said channels and adjacent materials.

2. Discussion of Prior Art

Metal channels are commonly used as components in many types of built assemblies. Currently, one of the primary problems associated with the use of these metal channels as framing members involves their high level of thermal transmission due to conductivity. In these built assemblies a thermal bridge is created by the metal channels through which heat may be transferred. The transfer of heat across this thermal bridge in turn manifests itself in the form of increased energy consumption. A number of attempts to solve this problem have been proposed; however, all of these prior proposals present significant disadvantages that severely limit and in some cases eliminate their practical application and use.

For example, U.S. Pat. No. 5,235,054 to Gilmour describes a thermal metallic building stud which attempts to limit contact between the metal framing member and adjacent materials via an upset pattern of punched protuberances which are pushed from the interior surfaces outwardly and cover the length and width of the stud flange. These punched projections present two significant problems: one involving the common use of mechanical fastening devices in conjuction with metal framing and one regarding the industry standardized structural widths currently used for metal framing members. Firstly, the distribution of projections across the width of the flange and away from the web serves as an obstruction to commonly used fasteners such as screws or nails. When hit, these protrusions can cause those fasteners to deflect and bend, as illustrated in FIGS. 4 and 5. Secondly, unless the total structural depth of the stud is reduced accordingly, whereby its load beating capacity is altered, the increased dimension resulting from the outwardly struck protuberances will hinder the use of the described thermal metallic building stud within standardized systems of metal runners and aim channels.

As a result, a need currently exists for thermally-improved metallic channels which possess characteristics not exhibited by the prior art. These specific characteristics are designated as the objects and advantages of the invention described herein.

OBJECTS AND ADVANTAGES OF THE INVENTION

It is an object of this novel invention to reduce the thermal conductance of metal channels by limiting the area of contact between said channels and adjacent materials.

It is a further object of this invention to achieve a limited contact with adjacent materials by deforming at least one flange of said thermally-improved metallic channel inwardly whereby a ridge at each edge of a singular flange or plurality of flanges is formed, thereby providing a point of contact with adjacent materials.

Is is another object of this invention to provide a reduced thermal conductance without creating an obstruction or hinderance to commonly used assembly methods which utilize fastening devices such as nails or screws.

It is yet another object of this invention to facilitate the use of mechanical fastening devices by restricting the location of ridges to the extreme edges of the flange surface, whereby the remainder of the flange surface is free from any obstructions that might otherwise hinder or restrict the use of said fastening devices.

It is a further object of this invention to reduce thermal conductance without having to necessarily effect or modify the standardized structural dimensions and characteristics of metal channels currently available thereby facilitating their use in existing standardized framing systems.

It is also an object of this invention to reduce the area of contact between said metal channels and adjacent materials by deforming inwardly the central portion of at least one flange whereby the surface contact between this flange and adjacent material is reduced while standardized structural dimensions may be maintained. This novel invention thereby provides an advantage for the use of thermally-improved metallic channels in conjuction with standardized metal runners and framing systems.

It is another object of this invention to provide thermally-improved metallic channels that can be inexpensively manufactured and that can be sold at a price competitive with wooden framing members having similar dimensional characteristics.

It is yet another object of this invention to provide thermally-improved metallic channels that meet the requirements of the various building codes.

Further objects and advantages of this invention will become apparent from a consideration of the drawings and ensuing description, wherein details have been described for purposes of disclosure without intending to limit the scope of the invention which is set forth in the appended claims.

List of Reference Numbers

Figure 1:
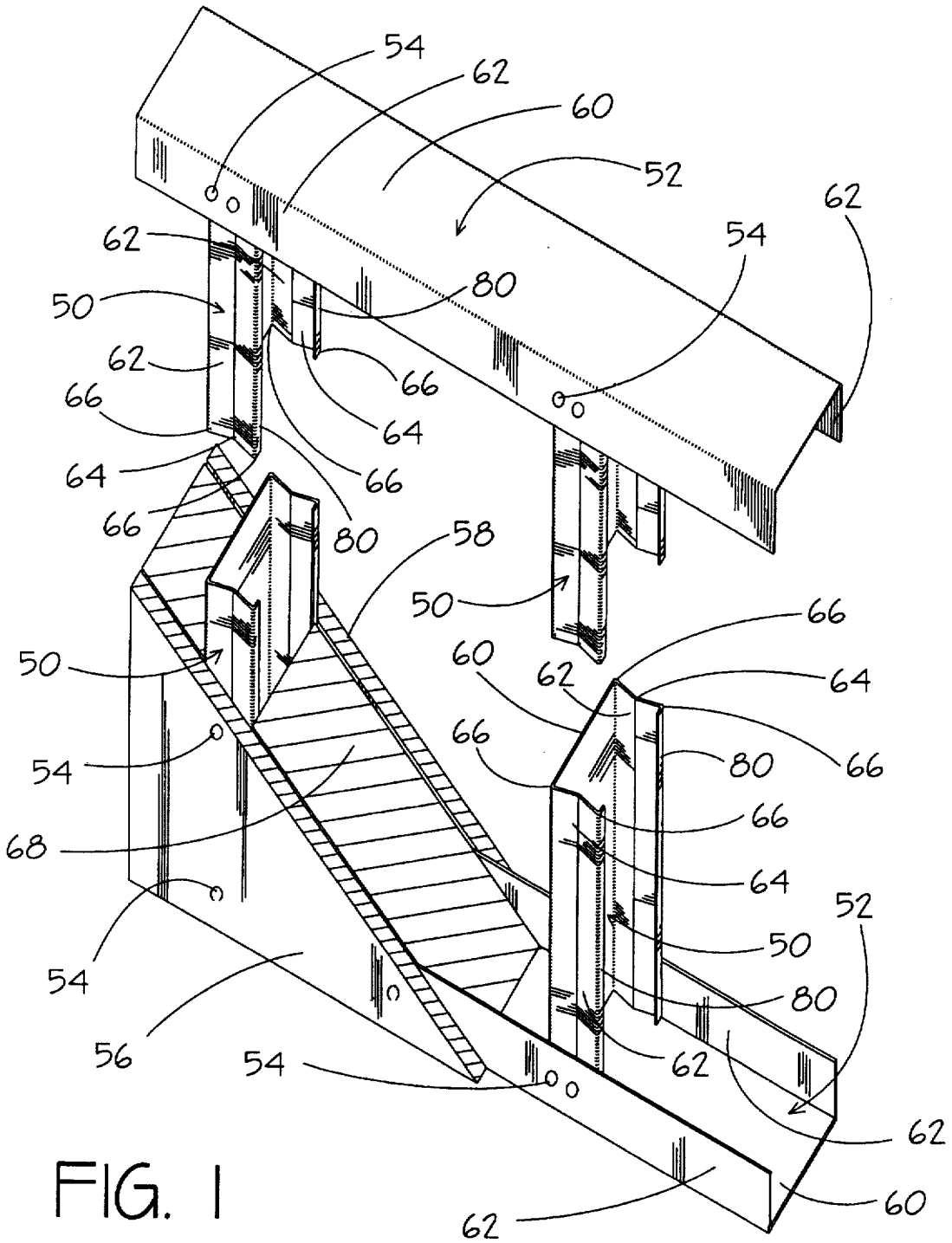
FIG. 1 is an axonometric view showing portions of thermally-improved metallic channels 50 along with connections to metallic runner channels 52 at their ends and interior and exterior adjacent materials 56,58 fastened to either side via mechanical fasteners 54.

50 thermally-improved metallic channel
52 metallic runner channel
54 mechanical fastener
56 internal adjacent material
58 external adjacent material
60 web
62 flange
64 inwardly-bent depression
66 contact ridge
68 insulating material
70 air space
72 edge of channel web having an industry standardized structural dimension
74 edge of channel web having a structural dimension not conforming to current industry standards
76 edge of channel with an overall outside dimension requiring a runner channel not conforming to current industry standards
78 outwardly punched protuberances
80 strengthening legs

SUMMARY OF THE INVENTION

This invention relates to configurations for a thermally-improved metallic channel comprising a substantially planar web of predetermined dimension, at least one flange extending substantially perpendicularly from said web, and reducing means whereby a depression in either a single flange or plurality of said flanges are used to decrease thermal conductance of said channel to adjacent material.

DESCRIPTION OF THE INVENTION

FIG. 1 illustrates an axonometric view showing portions of several construction components as they are arranged in a built assembly. There is a new thermally-improved metallic channel 50 attached at its ends to metallic runner channels 52 using mechanical fasters such as screws 54. Runner channels 52 are generally U-shaped in cross section. On one face of the built assembly, an interior adjacent material 56 is affixed to flange 62 of thermally-improved metallic channel 50 and flange 62 of metallic runner channels 52 using mechanical fasteners 54. The runner channels 52 are coextensive in length with the width of one of the flanges 62, and the runner channel is coextensive in length with an adjacent material 56 or 58 to position one of the longitudinal extremities of the flanges along a longitudinal extremity of the adjacent material. Configured in this way, the U-shaped cross section provides a socket for receiving the longitudinal extremity of the flange 62. On an opposite side of the built assembly, an exterior adjacent material 58 is affixed to flange 62 of thermally-improved metallic channel 50 and flange 62 of metallic runner channel 52 using mechanical fasteners 54. Preferably, interior adjacent material 56 and adjacent exterior material 58 have at least one planar surface. In the present instance, adjacent materials 56,58 have two parallel planar surfaces. Preferably, a second one of the longitudinal extremities of the flanges 62 is positioned along a second longitudinal extremity of one of the adjacent materials 56,58, and a second runner track 52 provides a second socket for receiving the second longitudinal extremity of the flange. A fastener rigidly connects the second longitudinal extremity of the flanges in the second socket and one of the adjacent materials 56,58. An insulating material 68 is positioned within a cavity formed by thermally-improved metallic channel 50 and adjacent material 56, 58. Both internal adjacent material 56 and external adjacent material 58 may vary in composition as they are not critical to individual performance of thermally-improved metallic channels 50 described herein.

Again referring specifically to FIG. 1, the invention resides in a configuration for a thermally-improved metallic channel designated as 50. Each thermally-improved metallic channel 50, although preferably formed from hot dipped galvanized strip steel having a generally uniform thickness throughout, may also be formed from other metals. The specific thickness of said metal may vary between fourteen gauge and twenty-seven gauge as prescribed by the American Iron and Steel Institute. The material used is sufficiently malleable so that the channel 50 is formed from an integral piece having fold lines connecting the different portions. The channels are generally comprised of a substantially planar web of predetermined dimension 60 and at least one flange 62 extending substantially perpendicularly from said web 60, the said flange 62 incorporating an inwardly-bent depression 64. Said inwardly-bent depression 64 extends along the length of said flanges 62. At each edge of flange 62 incorporating inwardly-bent depression 64 there is formed a contact ridge 66. Said contact ridge 66, extending the length of thermally-improved metallic channel 50, constitutes an area which contacts adjacent materials 56, 58. A thermal break in the form of an air space 70 is created between contact ridges 66 whereby the area subject to conductive thermal transmittance is significantly reduced. Strengthening legs 80 are located along the edge of flanges 62 opposite web 60 and extend substantially perpendicular to said flanges 62. Configurations for a thermally-improved metallic channel include the use of inwardly-bent depressions 64 and resulting contact ridges 66 on a single flange and plurality of flanges 62. Although FIG. 1 represents a built assembly incorporating one preferred embodiment of the thermally improved metallic channel 50, it must be understood that channels encompassed by this invention are not limited to this exact number of flanges or particular configuration.

Figure 2:
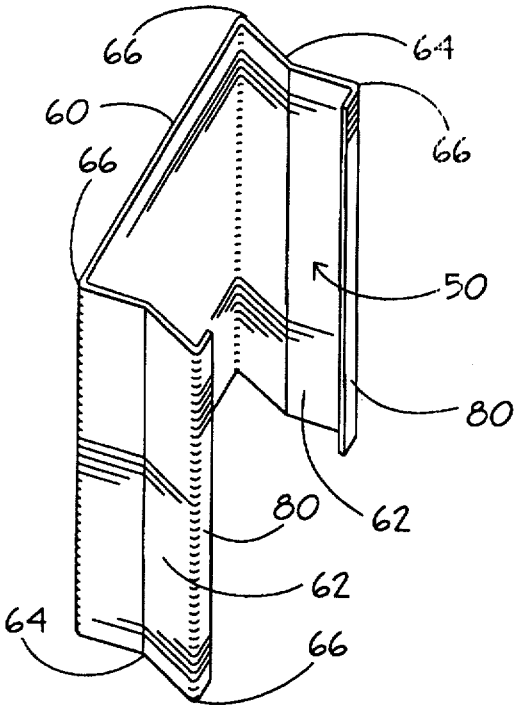
FIG. 2 illustrates an axonometric view of a thermally-improved metallic channel 50 that incorporates a V-shaped inwardly-bent depression 64 in a plurality of flanges 62.
Figure 2A:
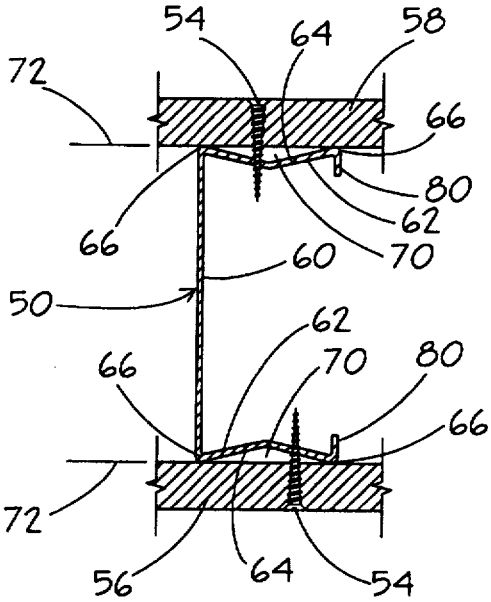
FIG. 2A illustrates a sectional view of a thermally-improved metallic channel 50 that incorporates a V-shaped inwardly-bent depression 64 in a plurality of flanges 62 and the attachment of said flanges 62 to adjacent material 56,58 via mechanical fasteners 54.

FIG. 2 and FIG. 2A illustrate in greater detail one preferred embodiment of a thermally-improved metallic channel 50 used in FIG. 1 built assembly. FIG. 2 is an axonometric view showing a substantially planar web of predetermined dimension 60 extending laterally between a plurality of flanges 62 extending transverse and preferably perpendicularly substantially from said web 60. Preferably, the channel 50 comprises two spaced-apart elongated flanges. Preferably, each of said flanges 62 projects transverse from one of the opposite longitudinal edges of the web 60. At least one of the flanges 62 confronts and supports interior adjacent material 56 or exterior adjacent material 58. A V-shaped inwardly-bent depression 64 is formed along the length of flanges 62. A contact ridge 66 is formed at each edge of inwardly-bent depression 64 and extends along the length of flanges 62.

Strengthening legs 80 extend substantially perpendicular to flanges 62 and are located along the length of flange edges opposite web 60. FIG. 2A is a plan view illustrating attachment of adjacent material 56,58 to thermally-improved metallic channel 50 via mechanical fasteners 54. Contact between adjacent material 56,58 and thermally improved metallic channel 50 is generally limited to contact ridge 66 at each end of inwardly-bent depression 64. An air space 70 between inwardly-bent depression 64 and adjacent materials 56,58 is created. As is shown in FIGS. 1 and 2A, a fastener rigidity connects one of the adjacent materials against the contact ridge 66. Preferably, the fastener extends through the inwardly-bent depression 64. The air space 70 is also enclosed at the top and bottom of channel 50 by the runner channel 52. Said air space 70 limits thermal conductivity between thermally-improved metallic channel 50 and adjacent material 56,58.

Figure 3:
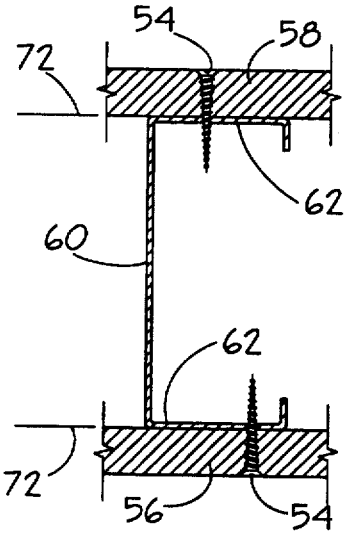
FIG. 3 PRIOR ART
FIG. 3 illustrates a sectional view of structurally standardized prior art and its connection to adjacent materials 56,58 via mechanical fasteners 54.

FIG. 3 illustrates a sectional view of prior art wherein the generally planar surface of flanges 62 maintains substantially continuous contact with adjacent materials 56,58 which are attached via mechanical fasteners 54. Such substantially continuous contact promotes thermal transfer via conductivity between prior art channel and adjacent material 56, 58.

Figure 4:
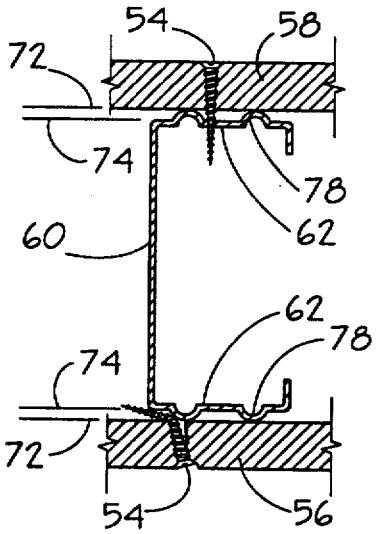
FIG. 4 PRIOR ART
FIG. 4 illustrates a sectional view of prior art and its connection to adjacent materials 56,58 via mechanical fasteners 54. Protuberances 78 create obstructions for mechanical fasteners 54 and require a modification to the otherwise industry standardized structural dimension of the web 60.
Figure 5:
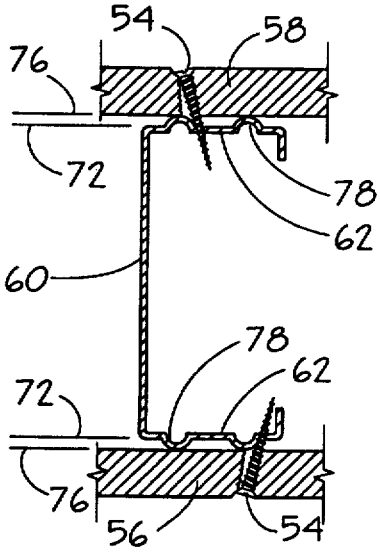
FIG. 5 PRIOR ART
FIG. 5 illustrates a sectional view of prior art and its Connection to adjacent materials 56,58 via mechanical fasteners 54. Protuberances 78 create obstructions for mechanical fasteners 54 and require a modification to industry standardized runner channels commonly attached to the base and top of said prior art channels.

FIG. 4 and FIG. 5 illustrate a sectional view of prior art wherein a pattern of outwardly-punched protuberances 78 are struck across the length and width of a channel flange 62. In FIG. 4 outwardly-punched protuberances 78 necessitate a reduction in the dimension 74 of prior art web 60 from an industry standardized structural dimension 72. Said outwardly-punched protuberances 78 positioned away from edges of said flange 62 also create obstructions for mechanical fasteners 54.

In FIG. 5 outwardly-punched protuberances 78 used with a standard structurally dimensioned 72 prior art web 60 necessitate an increased width 76 for metallic runner channels and other standardized framing components. This relationship between said prior art channel and width of metallic runner channel 52 may be understood more clearly with reference to the FIG. 1 built assembly. In FIG. 5, outwardly-punched protuberances 78 positioned away from edges of said flange 62 also create obstructions for mechanical fasteners 54.

Figure 6:
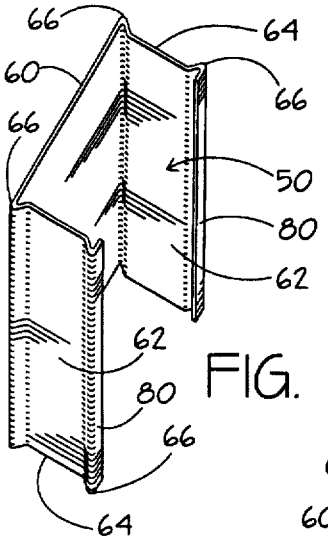
FIG. 6 illustrates an axonometric view of a thermally-improved metallic channel 50 that incorporates a flattened inwardly-bent depression 64 in a plurality of flanges 62.
Figure 6A:
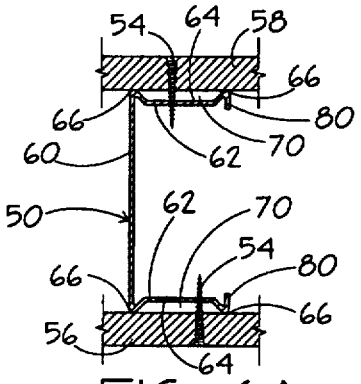
FIG. 6A illustrates a sectional view of a thermally-improved metallic channel 50 that incorporates a flattened inwardly-bent depression 64 in a plurality of flanges 62 and the attachment of said flanges 62 to adjacent material 56,58 via mechanical fasteners 54.

FIG. 6 and FIG. 6A illustrate a modification to an inwardly-bent depression 64 on a plurality of flanges 62 of a thermally-improved metallic channel 50. The inwardly-bent depression 64 is herein flattened so that it is substantially planar and parallel to the planar surface of an adjacent material 56,58 and extends along the length of said flanges 62.

Figure 7:
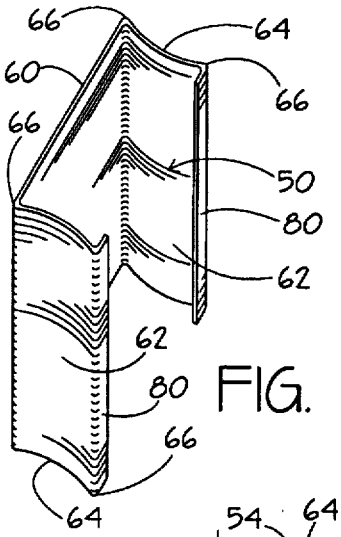
FIG. 7 illustrates an axonometric view of a thermally-improved metallic channel 50 that incorporates a concave inwardly-bent depression 64 in a plurality of flanges 62.
Figure 7A:
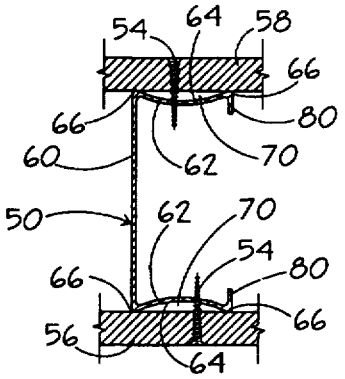
FIG. 7A illustrates a sectional view of a thermally-improved metallic channel 50 that incorporates a concave inwardly-bent depression 64 in a plurality of flanges 64 and the attachment of said flanges 62 to adjacent material 56,58 via mechanical fasteners 54.

FIG. 7 and FIG. 7 A illustrate a further modification to an inwardly-bent depression 64 on a plurality of flanges 62 so that the air space 70 is rectangular in cross section. As is shown in FIGS. 6 and 6A, that contact ridges 66 are preferably continuous ribs along the length of the flanges 62 of a thermally-improved metallic channel 50. The inwardly-bent depression 64 is herein concave and extends along the length of said flanges 62.

Figure 8:
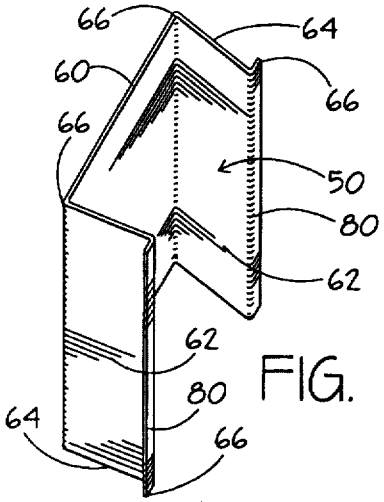
FIG. 8 illustrates an axonometric view of a thermally-improved metallic channel 50 that incorporates a sloped inwardly-bent depression in a plurality of flanges 64.
Figure 8A:
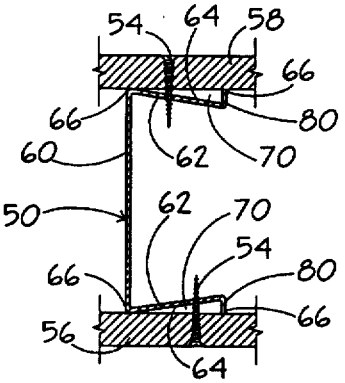
FIG. 8A illustrates a sectional view of a thermally-improved metallic channel 50 that incorporates a sloped inwardly-bent depression 64 in a plurality of flanges 62 and the attachment of said flanges 62 to adjacent material 56,58 via mechanical fasteners 54.

FIG. 8 and FIG. 8A illustrate a still further modification to an inwardly-bent depression 64 on a plurality of flanges 62 of a thermally-improved metallic channel 50. The inwardly-bent depression 64 is herein sloped and extends along the length of said flanges 62.

Figure 9:
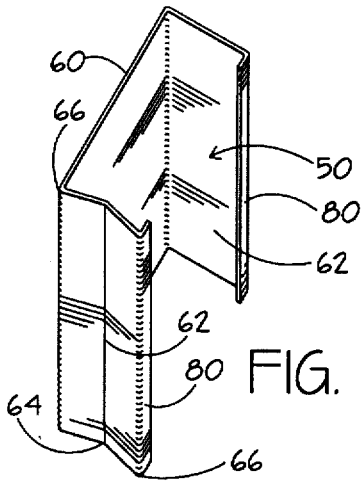
FIG. 9 illustrates an axonometric view of a thermally-improved channel 50 with an example of an inwardly-bent depression 64 as it might be used in a single flange 62.
Figure 9A:
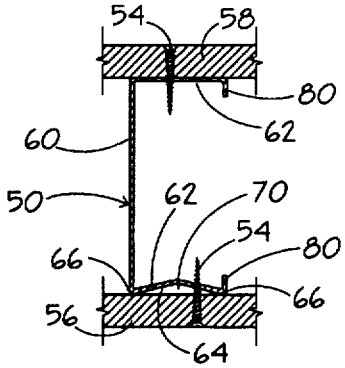
FIG. 9A illustrates a sectional view of a thermally-improved metallic channel 50 that incorporates an inwardly-bent depression 64 in a single flange 62 and the connection of said flanges to adjacent material 56,58 via mechanical fasteners 54.
Figure 10:
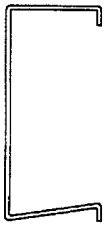
FIG. 10 and 10A–10F illustrate a plurality of configurations for thermally-improved metallic channels having a generally C-shaped cross-section in which one flange is straight and one flange incorporates an inwardly-bent depression.
Figure 10A:
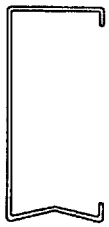
Figure 10B:
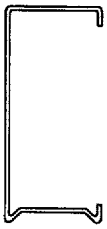
Figure 10C:
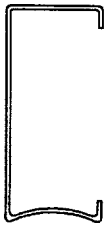
Figure 10D:
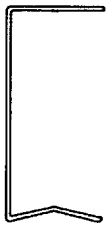
Figure 10E:
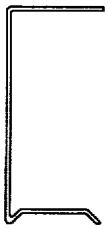
Figure 10F:
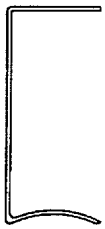
Figure 11:
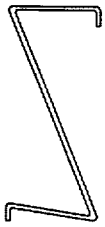
FIG. 11 AND 11A–F illustrate a plurality of configurations for thermally-improved metallic channels having a generally S-shaped cross-section in which one flange is straight and one flange incorporates an inwardly-bent depression.
Figure 11A:
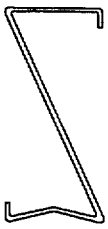
Figure 11B:
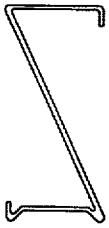
Figure 11C:
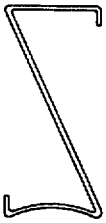
Figure 11D:
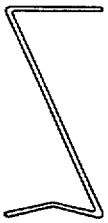
Figure 11E:
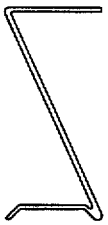
Figure 11F:
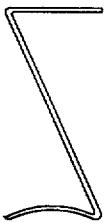
Figure 12:
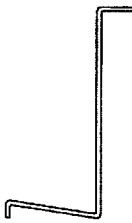
FIG. 12 and 12A–12A illustrate a plurality of configurations for thermally-improved metallic channels in which the flanges extend in opposite directions from the web, and one of the flanges is straight.
Figure 12A:
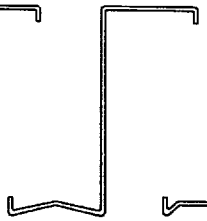
Figure 12B:
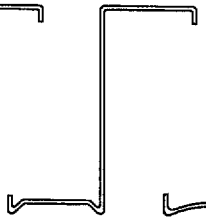
Figure 12C:
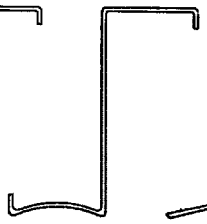
Figure 12D:
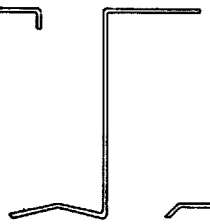
Figure 12E:
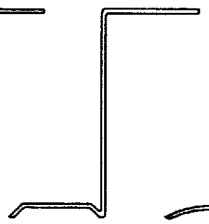
Figure 12F:
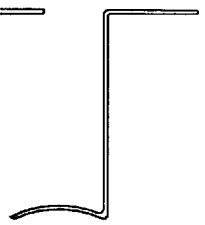
Figure 13:
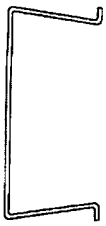
FIG. 13 and 13A–13F illustrate the configurations of FIG. 10 and 10A–10F in which both flanges incorporate an inwardly-bent depression.
Figure 13A:
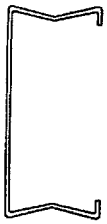
Figure 13B:
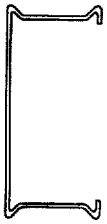
Figure 13C:
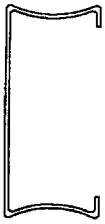
Figure 13D:
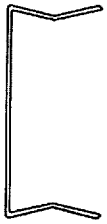
Figure 13E:
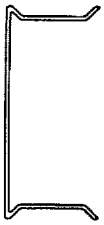
Figure 13F:
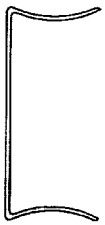
Figure 14:
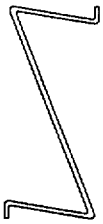
FIG. 14 and 14A–14F illustrate the channel configurations of FIG. 11 and FIG. 11A–11F, in which both flanges incorporate inwardly-bent depressions.
Figure 14A:
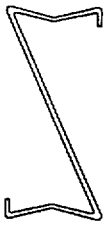
Figure 14B:
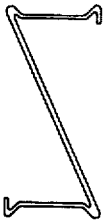
Figure 14C:
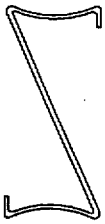
Figure 14D:
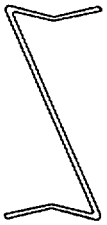
Figure 14E:
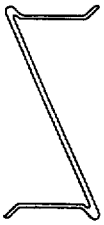
Figure 14F:
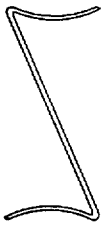
Figure 15:
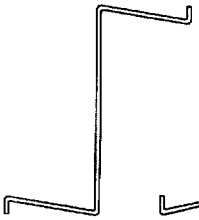
FIG. 15 and 15A–15F illustrate the channel configurations of FIG. 12 and FIG. 12A–12F in which both flanges incorporate an inwardly-bent depression.
Figure 15A:
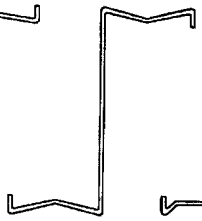
Figure 15B:
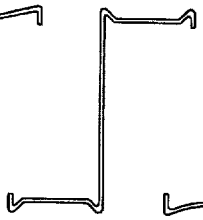
Figure 15C:
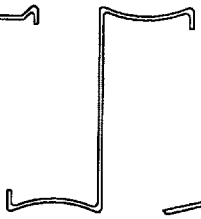
Figure 15D:
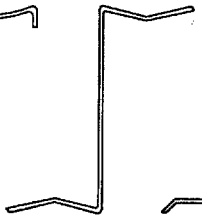
Figure 15E:
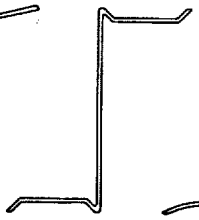
Figure 15F:
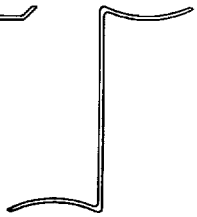
Figure 16:
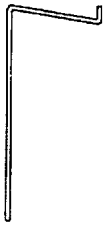
FIG. 16 and 16A–16F illustrate a plurality of configurations for thermally-improved metallic channels having only one flange.
Figure 16A:
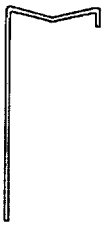
Figure 16B:
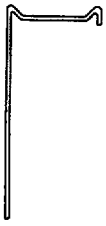
Figure 16C:
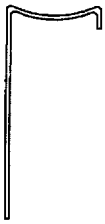
Figure 16D:
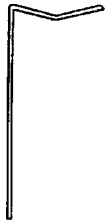
Figure 16E:
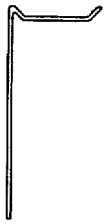
Figure 16F:
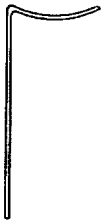

FIG. 9 and FIG. 9A illustrate a modification of a thermally-improved metallic channel 50 comprising a substantially planar web 60 of predetermined dimension and a plurality of flanges 62 extending substantially perpendicular from said web 60. A single flange 62 incorporates an inwardly-bent depression 64. Contact ridges 66 are located at the edges and extend along the length of said inwardly-bent depression 64. In other words, where previous figures illustrate the use of inwardly-bent depressions 64 on a plurality of flanges 62 it should be realized that such depressions 64 could be located on a single flange 62 without departing from the spirit of the invention.

FIG. 10 through FIG. 16F illustrate a plurality of configurations for thermally-improved metallic channels 50 that incorporate inwardly-bent depressions in their flanges. Said configurations illustrating thermally-improved metallic channel 50 with strengthening legs and without strengthening legs.

Figure 17:
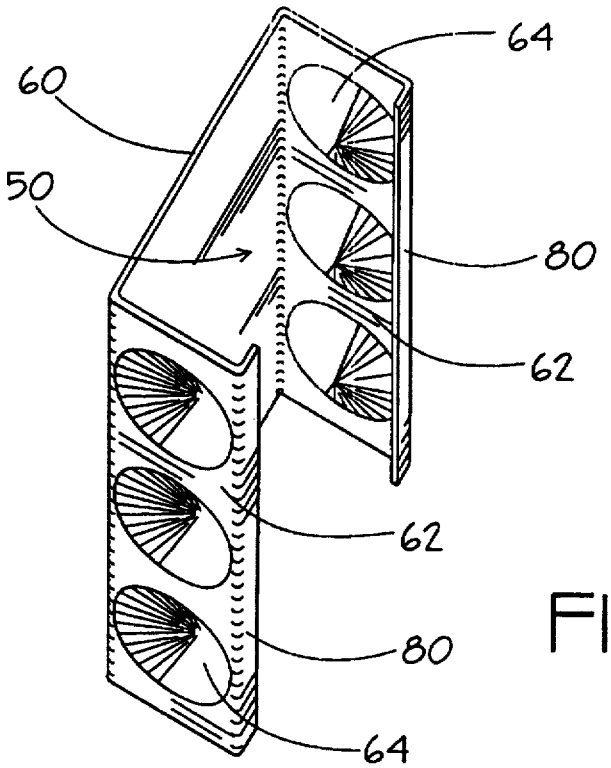
FIG. 17 and FIG. 18 illustrate axonometric views of thermally-improved metallic channels 50 wherein a longitudinally-spaced series of inwardly-bent depressions 64 are used.
Figure 18:
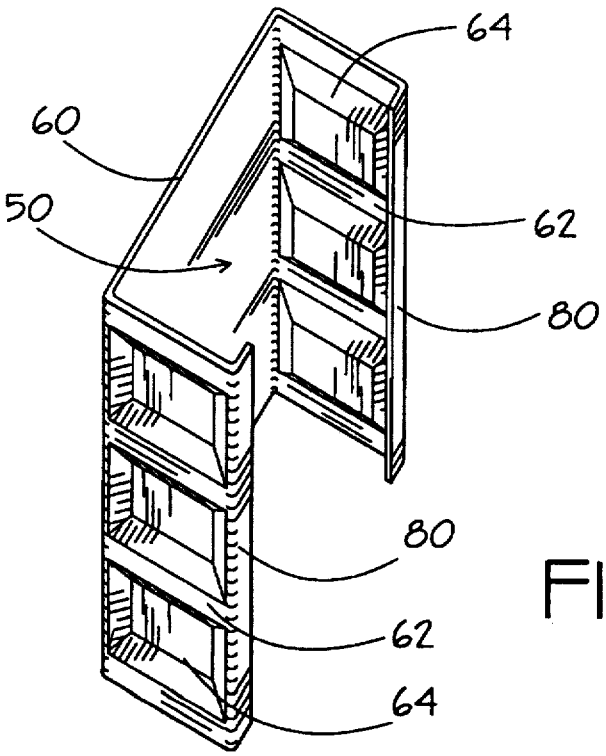

FIG. 17 and FIG. 18 illustrate axonometric views of a thermally-improved metallic channel 50 comprising a substantially planar web 60 and a plurality of flanges 62 extending generally perpendicular from said web 60. A plurality of inwardly-bent depressions are spaced apart one from the other and substantially aligned along the longitudinal axis of said plurality of flange 62. Strengthening legs 80 extend generally perpendicular to flanges 62 and are located along the length of flange edges opposite web 60.

OPERATION OF INVENTION

The manner of using a thermally-improved metallic channel of the invention is substantially identical to that for metallic channels in present use. In the FIG. 1 built assembly for example, a thermally-improved metallic channel 50 is attached at its ends or at points along its length to other framing members, herein designated as metallic runner channels 52. This attachment is typically accomplished through a use of mechanical fasteners 54 or welding. Adjacent material 56,58 is generally affixed to at least one face of the built assembly using mechanical fasteners 54. An insulating material 68 is positioned within a cavity formed by thermally-improved metallic channel 50, metallic runner channel 52, and adjacent material 56,58. Within this built assembly, a thermally-improved metallic channel 50 operates through the incorporation of an inwardly-bent depression 64 into at least one flange 62.

A reduced contact area between thermally-improved metallic channel 50 and adjacent materials 56, 58 results from this incorporation of inwardly-bent depression 64 whereby thermal transmittance due to conductivity is decreased. In other words, by incorporating a thermally-improved metallic channel 50 into a built assembly, the cumulative insulation value for that built assembly is improved. Furthermore, the improvement is achieved without necessitating a dimensional modification of standardized framing systems or creating an obstruction for commonly used fastening devices.

Thus the thermally-improved metallic channel of the invention provides an economic and energy saving component capable of reducing thermal loss and gain through conductivity with adjacent materials. In addition, the inwardly-bent depression described herein possesses the following advantages:

The depression permits channels of the invention to be used in conjuction with currently existing industry standardized framing systems without necessitating a modification of other system components.

The depression allows the web width of thermally-improved metallic channels to remain consistent with standardized structural dimensions for commonly used framing members.

The depression readily accomodates the use of mechanical fastening devices thereby eliminating deflection, bending or breakage of these devices due to obstructions located toward the center of channel flanges.

While the above description contains many specifications, these should not be construed as limitations on the scope of the invention, but rather as an exemplification of preferred embodiments thereof. Many other variations of the thermally improved metallic channel are possible. For example, FIG. 10 through FIG. 16F illustrate a plurality of thermally-improved channel configurations that incorporate inwardly bent depressions in both a single and a plurality of flanges. These inwardly bent depressions could have shapes other than those illustrated by the figures described herein. In addition, the thermally improved channels of the invention may also be produced from a number of other materials for which thermal conductivity is a concern. These materials include, but are not limited to, uncoated steel, stainless steel, and aluminum. Accordingly, the scope of the invention should be determined not by the embodiments illustrated, but by the appended claims and their legal equivalents wherein various portions have been separated for clarity of reading and not for emphasis.

I claim:

1. A thermally improved framing assembly, comprising:

a planar wall component;

a bottom metallic runner having a substantially flat face and at least one substantially flat flange extending transversely from said flat face;

a metallic channel disposed transverse to said bottom metallic runner, said metallic channel comprising an elongated web and at least one elongated flange extending transversely from said web, said at least one elongated flange comprising first and second continuous ridges along the length of said at least one elongated flange which contact an inner edge of said at least one substantially flat flange of said bottom metallic runner and confront and support said planar wall component along first and second lines of contact transverse to said substantially flat face of said bottom metallic runner, and said at least one elongated flange further comprising an offset portion laterally spaced from said planar wall component, said offset portion extending between said first and second ridges approximately the entire width of said at least one elongated flange along the length of said metallic channel; and fastening means for connecting said planar wall component against said first and second ridges of said at least one elongated flange of said metallic channel, said fastening means extending through said planar wall component and said at least one elongated flange to rigidly connect said planar wall component to said at least one elongated flange so as to form a closed air pocket between said planar wall component and said offset portion of said at least one elongated flange which is bounded on either side by said first and second lines of contact formed between said first and second ridges and said planar wall component and which is bounded on one end by said bottom metallic runner.

2. A framing assembly as in claim 1, further comprising a top metallic runner having a substantially flat face and at least one substantially flat flange extending transversely from said flat face, said metallic channel being disposed transverse to said top metallic runner so that said first and second ridges contact an inner edge of said at least one substantially flat flange of said top metallic runner along third and fourth lines of contact transverse to said substantially flat face of said top metallic runner, whereby said closed air pocket is further bounded on an end opposite said one end by said top metallic runner.

3. A framing assembly as in claim 1, wherein said metallic channel further comprises a strengthening lip projecting from said at least one elongated flange from an edge of said at least one elongated flange which is remote from said web.

4. A framing assembly as in claim 3, wherein said metallic channel is formed from an integral sheet of malleable metal having fold lines connecting said web, said at least one elongated flange and said strengthening lip.

5. A framing assembly as in claim 1, wherein said first and second ridges are formed by continuous ribs along the length of said at least one elongated flange, said ribs contacting said planar wall component along said first and second lines of contact transverse to said substantially flat face of said bottom metallic runner.

6. A framing assembly as in claim 1, wherein said offset portion of said metallic channel is substantially planar and parallel to said planar wall component so that said closed air pocket is generally rectangular in cross-section.

7. A framing assembly as in claim 1, wherein said offset portion comprises two sections, one of said sections being connected to said first ridge adjacent said web and projecting away from said planar wall component, the other of said sections being connected to said second ridge at an end of said at least one elongated flange remote from said web and projecting away from said planar wall component, said two sections being connected at an angle at a point intermediate said first and second ridges.

8. A framing assembly as in claim 7, wherein said section connected to said second ridge projects away from said planar wall component in a transverse direction and said angle is an acute angle.

9. A framing assembly as in claim 1, wherein said offset portion has a curved cross-section between said first and second ridges.

* * * * *

UNITED STATES PATENT AND TRADEMARK OFFICE

CERTIFICATE OF CORRECTION

PATENT NO. : 5,592,796

DATED : January 14, 1997

INVENTOR(S) : LeRoy A. Landers

It is certified that error appears in the above-indentified patent and that said Letters Patent is hereby corrected as shown below:

Column 1, Line 64 - "Is" should be typed as "It".

Column 3, Line 42 - "12A-12A" should be typed as "12A-12F".

Column 5, Line 37 - The word "the" should be inserted before "FIG. 1".

Column 6, Line 33 - After "said flanges 62", the following should be inserted "so that the air space 70 is rectangular in cross section. As is shown in FIGS. 6 and 6A, that contact ridges 66 are preferably continuous ribs along the length of the flanges 62".

Column 6, Line 35 - After "62", the following should be deleted "so that the air space 70 is rectangular in cross section. As is shown in FIGS. 6 and 6A, that contact ridges 66 are preferably continuous ribs along the length of the flanges 62".

UNITED STATES PATENT AND TRADEMARK OFFICE

CERTIFICATE OF CORRECTION

PATENT NO. : 5,592,796

DATED : January 14, 1997

INVENTOR(S) : LeRoy A. Landers

It is certified that error appears in the above-indentified patent and that said Letters Patent is hereby corrected as shown below:

Column 7, Line 64 - After the word "single" the word "flange" should be typed.

Signed and Sealed this

Twenty-second Day of July, 1997

Bruce Lehman

*Attest:*

BRUCE LEHMAN

*Attesting Officer*

*Commissioner of Patents and Trademarks*